US010761445B2

(12) United States Patent
Kagan et al.

(10) Patent No.: US 10,761,445 B2
(45) Date of Patent: Sep. 1, 2020

(54) ELECTROPHOTOGRAPHIC INK INCLUDING PEARLESCENT PIGMENT

(71) Applicant: HP Indigo B.V., Amstelveen (NL)

(72) Inventors: Olga Kagan, Nes Ziona (IL); Emad Masoud, Nes Ziona (IL); Yana Reznick, Nes Ziona (IL); Rada Nuchimov, Nes Ziona (IL); Danny Feldman, Nes Ziona (IL); Haim Cohen, Nes Ziona (IL); Shiran Zabar, Nes Ziona (IL); Yaron Grinwald, Nes Ziona (IL); Michael Kokotov, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/068,562

(22) PCT Filed: Mar. 24, 2016

(86) PCT No.: PCT/EP2016/056647

§ 371 (c)(1),
(2) Date: Jul. 6, 2018

(87) PCT Pub. No.: WO2017/162302

PCT Pub. Date: Sep. 28, 2017

(65) Prior Publication Data

US 2019/0018332 A1 Jan. 17, 2019

(51) Int. Cl.

| | |
|---|---|
| ***G03G 9/08*** | (2006.01) |
| ***G03G 9/12*** | (2006.01) |
| ***G03G 9/125*** | (2006.01) |
| ***G03G 9/13*** | (2006.01) |
| ***G03G 9/135*** | (2006.01) |

(52) U.S. Cl.

CPC ..... *G03G 9/122* (2013.01); *G03G 9/0804* (2013.01); *G03G 9/125* (2013.01); *G03G 9/131* (2013.01); *G03G 9/1355* (2013.01)

(58) Field of Classification Search

CPC ..... G03G 9/122; G03G 9/131; G03G 9/135

See application file for complete search history.

(56) References Cited

U.S. PATENT DOCUMENTS

| | | | | |
|---|---|---|---|---|
| 4,755,229 | A | 7/1988 | Armanini | |
| 6,432,195 | B1 | 8/2002 | Rathschlag et al. | |
| 8,900,658 | B2 | 12/2014 | Nguyen et al. | |
| 2010/0095868 | A1 | 4/2010 | Kaupp et al. | |
| 2011/0064779 | A1 | 3/2011 | Gruener et al. | |
| 2013/0288175 | A1* | 10/2013 | Chun | G03G 13/10 430/112 |
| 2013/0302733 | A1 | 11/2013 | Chun et al. | |
| 2015/0111149 | A1* | 4/2015 | Chun | G03G 9/122 430/115 |
| 2015/0175826 | A1* | 6/2015 | Mor | C09C 3/10 252/512 |
| 2015/0259536 | A1 | 9/2015 | Gruener et al. | |
| 2015/0323879 | A1* | 11/2015 | Kabalnov | C09D 11/037 428/207 |

FOREIGN PATENT DOCUMENTS

| | | |
|---|---|---|
| EP | 2047335 | 4/2009 |
| WO | 2013180716 | 12/2013 |

OTHER PUBLICATIONS

Technical Datasheet of Phoenix PX 1000 L (https://polymer-additives.specialchem.com/product/p-eckart-phoenix-px-1000-I).*

International Search Report dated Dec. 14, 2016 for PCT/EP2016/056647, Applicant Hewlett-Packard Indigo B. V.

* cited by examiner

*Primary Examiner* — Peter L Vajda

(74) *Attorney, Agent, or Firm* — Thorpe North & Western LLP

(57) ABSTRACT

According to an example, a resin, a carrier liquid, and a pearlescent pigment may be mixed to form a liquid electrophotographic ink.

11 Claims, No Drawings

ELECTROPHOTOGRAPHIC INK INCLUDING PEARLESCENT PIGMENT

BACKGROUND

Ink compositions containing charged particles are used in a wide variety of applications such as toners in electrophotography printing, pigmented ink, electrophoretic displays as well as many other applications. Liquid electrophotographic printing is a specific type of electrophotographic printing where a liquid ink is employed in the process rather than a powder toner.

DETAILED DESCRIPTION

For simplicity and illustrative purposes, the present disclosure is described by referring mainly to examples thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

The liquid electrophotographic ink disclosed herein may be formed by mixing a resin, a carrier liquid, and a pearlescent pigment. It will be noted that the method disclosed herein may vary from prior methods because the resin, carrier liquid, and pearlescent pigment are not subjected to mechanical deformation, such as grinding. Through implementation of the disclosed method, in which the pearlescent pigment does not undergo a mechanical deformation, the resultant liquid electrophotographic ink may exhibit an increased glitter and/or sparkle as compared with inks in which the pearlescent pigments have undergone mechanical deformation.

Generally, a carrier liquid may act as a dispersing medium for the other components in the liquid electrophotographic ink. The carrier liquid may have or be a hydrocarbon, silicone oil, vegetable oil, etc. The carrier liquid may include, but is not limited to, an insulating, non-polar, non-aqueous liquid that may be used as a medium for articles. In an aspect, the carrier liquid may be a low dielectric (<2 dielectric constant) solvent.

The carrier liquid may include, but is not limited to, hydrocarbons. The hydrocarbon may include, but is not limited to, an aliphatic hydrocarbon, an isomerized aliphatic hydrocarbon, branched chain aliphatic hydrocarbons, aromatic hydrocarbons, and combinations thereof. Non-limiting examples of a carrier liquid may include aliphatic hydrocarbons, isoparaffinic compounds, paraffinic compounds, dearomatized hydrocarbon compounds, and the like. In particular, the carrier liquid may be chosen from Isopar-G™, Isopar-H™, Isopar-L™, Isopar-M™, Isopar-K™, Isopar-V™, Norpar 12™, Norpar 13™, Norpar I5™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 3QQ™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

The carrier liquid may be present in the liquid electrophotographic ink composition in an amount ranging from about 20% to about 99.5% by weight of the electrophotographic ink composition, and in some examples about 50% to about 90% by weight of the electrophotographic ink composition. In another example, the carrier liquid may be present in an amount ranging from about 60% to about 80% by weight of the electrophotographic ink composition.

The resin used in the liquid electrophotographic ink composition may include a polymer. The resin may include, but is not limited to, a thermoplastic polymer. The polymer of the resin may be selected from ethylene acrylic acid copolymers; methacrylic acid copolymers; ethylene vinyl acetate copolymers; copolymers of ethylene (e.g. from about 80 wt. % to about 99.9 wt. %), and alkyl (e.g. $C_1$ to $C_5$) ester of methacrylic or acrylic acid (e.g. from about 0.1 wt. % to about 20 wt. %); copolymers of ethylene (e.g. from about 80 wt. % to about 99.9 wt. %), acrylic or methacrylic acid (e.g. from about 0.1 wt. % to about 20.0 wt. %) and alkyl (e.g. $C_1$ to $C_5$) ester of methacrylic or acrylic acid (e.g. from about 0.1 wt. % to about 20 wt. %); polyethylene; polystyrene; isotactic polypropylene (crystalline); ethylene ethyl acrylate; polyesters; polyvinyl toluene; polyamides; styrene/butadiene copolymers; epoxy resins; acrylic resins resins (e.g. copolymer of acrylic or methacrylic acid and at least one alkyl ester of acrylic or methacrylic acid wherein alkyl is in some examples from about 1 to about 20 carbon atoms, such as methyl methacrylate (e.g. from about 50 wt. % to about 90 wt. %)/methacrylic acid (e.g. from about 0 wt. % to about 20 wt. %)/ethylhexylacrylate (e.g. from about 10 wt. % to about 50 wt. %)); ethylene-acrylate terpolymers: ethylene-acrylic esters-maleic anhydride (MAH) or glycidyl methacrylate (GMA) terpolymers; ethylene-acrylic acid ionomers and combinations thereof.

The resin may constitute about 5% to about 90%, in some examples about 5% to about 80%, by weight of the solids of the liquid electrophotographic ink composition. Additionally, the resin may constitute about 10% to about 60% by weight of the solids of the liquid electrophotographic ink composition. Moreover, the resin may constitute about 15% to about 40% by weight of the solids of the liquid electrophotographic ink composition.

Non-limiting examples of the resin include the Nucrel family of toners (e.g. Nucrel 403™, Nucrel 407™ Nucrel 609HS™, Nucrel 908HS™ Nucrel 1202HC™, Nucrel 30707™, Nucrel 1214™, Nucrel 903™, Nucrel 399Q™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of toners (e.g. Aclyn 201, Aclyn 246, Aclyn 285, and Aclyn 295), and the Lotader family of toners (e.g. Lotader 2210, Lotader, 3430, and Lotader 8200 (sold by Arkema)) and AC5120 (an ethylene acrylic acid copolymer from Allied Signal).

The resin may encapsulate the pigment during mixing to create an ink particle. The ink particle may have a final particle size ranging from about 1 micron to about 10 microns. The resin encapsulated pigments may be formulated to provide a specific melting point. In one example, the melting point may be from about 30° C. to about 150° C., and for example, from about 50° C. to about 100° C. Such melting points may allow for desired film formation during printing.

The liquid electrophotographic ink composition may include a pigment. Non-limiting examples of pigments include cyan pigments, magenta pigments, yellow pigments, white pigments, black pigments, phosphorescent pigments, electroluminescent pigments, photoluminescent pigments, pearlescent pigments, and combinations thereof. According to an example, the pigment may be a phosphorescent pigment having strontium oxide aluminate phosphor particles. The phosphorescent pigment may be chosen from LUMINOVA® BGL-300FF (blue-green emitting), LUMINOVA® GLL-300FF (green emitting), and LUMINOVA® V-300M (violet emitting), GBU (yellowish green emitting), all of which are available from United Mineral and Chemical Corporation; UltraGreen V10(PDPG) (green emitting) available from Glow Inc.; and LUPL34/2 (turquoise emitting), LUPL24/2 (green emitting), LUPLO9 (orange emitting), all of which are available from Luminochem from Hungary, Budapest.

The liquid electrophotographic ink may have a pearlescent pigment (also may be referred to as an interference pigment) that may produce a color effect, for example, the color may change as the visual angle of a viewer shifts, also for example an interference effect. The substrate of the pigment may have a thickness that may cause a path length of the reflected light to differ. If the incident light is at a sharper or wider angle, the reflected light may have a different wavelength and different reflected colors. In an example, the pearlescent pigment may be a mica particle coated with a metal oxide. The mica may be a naturally occurring mica or a synthetic mica. The metal oxide may be titanium dioxide or iron oxide. The pearlescent pigment may have alternating layers of a material with a low refractive index and of a material with a high refractive index.

In another example, the pearlescent pigment may have a substrate selected from mica, talc, sericite, kaolin, platelets of silicon dioxide, glass, graphite, synthetic calcium aluminum borosilicate, or mixtures thereof. The substrate may be transparent. The substrate may be coated with one or more metal oxides such as $TiO_2$, $Fe_2O_3$, $Fe_3O_4$, $TiFe_2O_5$, ZnO, $SnO_2$, CoO, $CO_3O_4$, $ZrO_2$, $Cr_2O_3VO_2$, $V_2O_3$, $(Sn,Sb)O_2$, and mixtures thereof. A non-limiting example may include IRIDESIUM-325, available from Jiang Su Pritty, a mica coated with titanium oxide and metal oxide, such as iron oxide.

The pearlescent pigment may be a metamer, i.e., the color of the pearlescent pigment may match the color perceived by a user under a standard light source, such as the sun, and/or under different light sources, such as fluorescent or halide lights. In an example, the pearlescent pigment may exhibit metamerism. The pearlescent pigment may be a rare earth oxysulfide, including but not limited to CAS 12162-58-2 diholmium-dioxide-sulphide, and CAS 12359-21 diprasEodymium-dioxide-sulfide.

A charge director imparts a charge to the liquid electrophotographic ink, which may be identical to the charge of a photoconductive surface. The electrophotographic ink composition may include a charge director having a sulfosuccinate salt of the general formula MAn, in which M is a metal, n is the valence of M, and A is an ion of the general formula (I):

$$[R^1—O—C(O)CH_2CH(SO_3)C(O)—O—R^2] \quad (I)$$

in which each of $R^1$ and $R^2$ may be an alkyl group.

The charge director may be added in order to impart and/or maintain sufficient electrostatic charge on the ink particles.

The sulfosuccinate salt of the general formula MAn may be an example of a micelle forming salt. The charge director may be substantially free or free of an acid of the general formula HA, where A is as described above. The charge director may include micelles of the sulfosuccinate salt enclosing at least some of the nanoparticles. The charge director may include at least some nanoparticles having a size of 200 nm or less, and/or in some examples 2 nm or more.

The charge director may further have a simple salt. Simple salts are salts that do not form micelles by themselves, although they may form a core for micelles with a micelle forming salt. The ions constructing the simple salts are all hydrophilic. The simple salt may include a cation selected from the group consisting of Mg, Ca, Ba, NH4, tert-butyl ammonium, Li+, and Al+3, or from any sub-group thereof. The simple salt may include an anion selected from the group consisting of $SO_4^{2-}$, $PO^{3-}$, $NO^{3-}$, $HPO_4^{2-}$, $CO_3^{2-}$, acetate, trifluoroacetate (TFA), $Cl^-$, $BF_4^-$, F−, $ClO_4$−, and $TiO_3^{4-}$, or from any sub-group thereof. The simple salt may be selected from $CaCO_3$, $Ba_2TiO_3$, $Al_2(SO_4)$, $Al(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)3$, $LiClO_4$ and $LiBF_4$, or any sub-group thereof. The charge director may further include basic barium petronate (BBP).

In the formula $[R^1—O—C(O)CH_2CH(SO_3^-)C(O)—O—R^2]$, for example each of $R^1$ and $R^2$ may be independently an aliphatic alkyl group, such as a $C_{6-25}$ alkyl. The aliphatic alkyl group may be linear or branched. The aliphatic alkyl group may have a linear chain of more than 6 carbon atoms. $R^1$ and $R^2$ may be the same or different. In some examples, at least one of $R^1$ and $R^2$ is $C_{13}H_{27}$. In some examples, M is Na, K, Cs, Ca, or Ba.

The charge director may further include one of, some of or all of (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and may be obtained, for example, from Chemtura. An example isopropyl amine sulphonate salt is dodecyl benzene sulfonic acid isopropyl amine, which is available from Croda.

In some examples, the charge director may constitute about 0.001 to about 20%, for example, from about 0.01% to about 20% by weight, as an additional example from about 0.01 to about 10% by weight, and as a further example from about 0.01% to about 1% by weight of the solids of an electrophotographic ink composition. The charge director may constitute from about 0.001% to about 0.15% by weight of the solids of the electrophotographic ink composition, for example from about 0.001% to about 0.15%, as a further example from about 0.001% to about 0.02% by weight of the solids of an electrophotographic ink composition, for example from about 0.1% to about 2% by weight of the solids of the electrophotographic ink composition, for example from about 0.2% to about 1.5% by weight of the solids of the electrophotographic ink composition in an example from about 0.1% to about 1% by weight of the solids of the electrophotographic ink composition, for example from about 0.2% to about 0.8% by weight of the solids of the electrophotographic ink composition. The charge director may be present in an amount of at least 1 mg of charge director per gram of solids of the electrophotographic ink composition (which will be abbreviated to mg/g), for example, at least 2 mg/g, in a further example at least 3 mg/g, in another example at least 4 mg/g, for example, at least 5 mg/g. The moderate acid may be present in the amounts stated above, and the charge director may be present in an amount of from about 1 mg to about 50 mg of charge director per gram of solids of the electrostatic ink composition (which will be abbreviated to mg/g), for example from about 1 mg/g to about 25 mg/g, as a further example from about 1 mg/g to about 20 mg/g, for example from about 1 mg/g to about 15 mg/g, as an additional example from about 1 mg/g to about 10 mg/g, for example from about 3 mg/g to about 20 mg/g, as a further example from about 3 mg/g to about 15 mg/g, and for example from about 5 mg/g to about 10 mg/g.

The electrophotographic ink composition may include a charge adjuvant. A charge adjuvant may promote charging of the particles when a charge director is present. The method as described here may involve adding a charge adjuvant at any stage. The charge adjuvant may include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Zn salts of stearic acid, Cu salts of stearic acid, Pb salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an example, the charge adjuvant may be or may include aluminum di- or tristearate. The charge adjuvant may be present in an amount of from about 0.1 to about 5% by weight, for example from about 0.1 to about 1% by weight, in some examples from about 0.3 to about 0.8% by weight of the solids of the electrophotographic ink composition, in some examples from about 1 wt. % to about 3 wt. % of the solids of the electrophotographic ink composition, in some examples from about 1.5 wt. % to about 2.5 wt. % of the solids of the electrophotographic ink composition.

In some examples, the electrophotographic ink composition may include, e.g., as a charge adjuvant, a salt of multivalent cation and a fatty acid anion. The salt of multivalent cation and a fatty acid anion may act as a charge adjuvant. The multivalent cation may, in some examples, be a divalent or a trivalent cation. In some examples, the multivalent cation may be selected from Group 2, transition metals and Group 3 and Group 4 in the Periodic Table. In some examples, the multivalent cation may include a metal selected from Ca, Sc, Ti, V, Cr, Mn, Fe, Co, Ni, Cu, Zn, Al and Pb. In some examples, the multivalent cation is Al3+. The fatty acid anion may be selected from a saturated or unsaturated fatty acid anion. The fatty acid anion may be selected from a $C_8$ to $C_{26}$ fatty acid anion, in some examples a $C_{14}$ to $C_{22}$ fatty acid anion, in some examples a $C_{16}$ to $C_{20}$ fatty acid anion, in some examples a $C_{17}$, $C_{18}$ or $C_{10}$ fatty acid anion. In some examples, the fatty acid anion may be selected from a caprylic acid anion, capric acid anion, lauric acid anion, myristic acid anion, palmitic acid anion, stearic acid anion, arachidic acid anion, behenic acid anion and cerotic acid anion.

The charge adjuvant, which may, for example, be or include a salt of multivalent cation and a fatty acid anion, may be present in an amount of from about 0.1 wt. % to about 5 wt. % of the solids of the electrophotographic ink composition, in some examples in an amount of from about 0.1 wt. % to about 2 wt. % of the solids of the electrophotographic ink composition, in some examples in an amount of from about 0.1 wt. % to about 2 wt. % of the solids of the electrostatic ink composition, in some examples in an amount of from about 0.3 wt. % to about 1.5 wt. % of the solids of the electrophotographic ink composition, in some examples from about 0.5 wt. % to about 1.2 wt. % of the solids of the electrophotographic ink composition, in some examples from about 0.8 wt. % to about 1 wt. % of the solids of the electrophotographic ink composition, in some examples from about 1 wt. % to about 3 wt. % of the solids of the electrophotographic ink composition, in some examples from about 1.5 wt. % to about 2.5 wt. % of the solids of the electrophotographic ink composition.

The resin, carrier liquid, and pearlescent pigment may be mixed to form a paste. The pearlescent pigment may be mixed with the resin and the carrier liquid at a temperature above a cloud point for the resin. The resin, carrier liquid, and pearlescent pigment may be subjected to high shear mixing conditions.

According to an example, the use of the mixer does not mechanically deform the pearlescent pigment like, for example, a grinder. The disclosed method is free from grinding the pearlescent pigment, the resin, and the carrier liquid. As a result, the formed liquid electrophotographic ink may exhibit an increased light reflection (as measured by a flop index) as compared to an electrophotographic ink that underwent mechanical deformation.

The temperature may decrease over time as the liquid electrophotographic ink is formed. In an example, the temperature may progressively decrease from about 140° C. to about 20° C., for example from about 135° C. to about 23° C., and as a further example from about 130° C. to about 25° C.

The liquid electrophotographic ink may have from about 1% to about 70% non-volatile solids, for example from about 5% to about 70%, and as a further example from about 10% to about 70% by weight non-volatile solids. The liquid electrophotographic ink may have from about 10% to about 70% pearlescent pigment, for example from about 15% to about 40%, and as a further example from about 20% to about 35%.

The following examples illustrate examples of the disclosure that are presently best known. However, it is to be understood that the following are only examples or illustrative of the application of the principles of the present disclosure. Numerous modifications and alternative compositions, methods, and systems may be devised by those skilled in the art without departing from the spirit and scope of the present disclosure. The claims are intended to cover such modifications and arrangements. Thus, while the present disclosure has been described above with particularity, the following examples provide further details in connection with what are presently deemed to be the most practical and preferred examples of the disclosure.

EXAMPLES

Example 1

63 g of resins (total) (NUCREL® 599, a 500 melt index ethylene-methacrylic acid co-polymer from DuPont, Wilmington, Del.) and AC5120 (an ethylene acrylic acid copolymer by Allied Signal) and 210 g ISOPAR L (available from Exxon Corporation) were added were at 30% non-volatile solids to a IKA overhead stirrer, type RE162/P at a temperature of about 130° C. at 3 rpm for 60 minutes. After the resins swelled, the temperature was decreased every 30 minutes about 20° C., (e.g., 120° C. for 30 minutes, 100° C. for 30 minutes, 80° C. for 30 minutes). When the temperature neared, but was still above, the cloud point for the resins, the T-25 digital ULTRA-TURRAX® high shear mixer, available from IKA was activated and 27 g (total) of the pearlescent pigments (Miraval 5426 Magic Green, available from Merck, and Colorstream T10-80, available from Merck) were added to the mixer at a feeding rate of 10 grams per 30 seconds. After the temperature was below the cloud point for the resins, the cooling rate was 10° C./hour, which continued until the temperature reached from about 60° C. to about 70° C. and then the cooling rate was 5° C./hour. After a temperature of 60° C., the cooling rate was about 10° C./hour.

15% non-volatile solids of the pearlescent pigments were diluted with 150 gram ISOPAR L and subjected to high shear mixing. The high shear mixing conditions were: temperature about 30° C. at 15,000 rpm for 1 hour. An electrophotographic ink was produced.

Example 2

An electrogphotographic ink was prepared using grinding. 1800 g of material (resins, carrier liquid, and pearlescent pigment from Example 1) was placed in a ceramic attritor at a temperature of 45° C. for 6 hours. The material included about 18% non-volatile solids. The final electrophotographic ink had 20% pearlescent pigment and 2% VCA (aluminum stearate).

A visual inspection of an image printed with the electrophotographic ink from Example 1 exhibited an increased glitter/sparkling effect as compared to an image printed with the electrophotographic ink from Example 2. The electrophotographic ink from Example 1 was free from grinding and the pearlescent pigment did not undergo mechanical deformation as a result of the grinding.

Example 3

The particle size distribution and the particle conductivity of the inks prepared from Examples 1 and 2 were determined. The results are in the Table below.

TABLE 1

Particle Size and Distribution

| | | Example 2 | Example 1 |
|---|---|---|---|
| PS distribution | d (0.5) (um) | 15.423 | 37.489 |
| | tail 20 um (%) | 38.194 | 64.67 |
| | tail 1.5 um (%) | 0.495 | 0.024 |
| Particle conductivity | LF | 55 | 58 |
| | HF | 162 | 63 |
| | PC | 107 | 5 |
| | DC | 10 | 7 |

As can be seen from the data in Table 1, the ink from Example 1 exhibited a lower particle conductivity as compared to the ink from Example 2.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure. What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A liquid electrophotographic ink comprising:

A carrier liquid;

a resin; and a pearlescent pigment encapsulated by the resin, wherein the pearlescent pigment includes alternating layers of a material with a low refractive index and a material with a high refractive index, wherein the material of the low refractive index is interchanged repeatedly with the material of the high refractive index;

wherein the resin, the carrier liquid, and the pearlescent pigment are not subjected to mechanical deformation.

2. The ink of claim 1, wherein the resin is selected from the group consisting of ethylene acrylic acid copolymers; methacrylic acid copolymers; ethylene vinyl acetate copolymers; copolymers of ethylene and alkyl ester of methacrylic or acrylic acid; copolymers of ethylene acrylic or methacrylic acid and alkyl ester of methacrylic or acrylic acid; copolymers of acrylic or methacrylic acid and at least one alkyl ester of acrylic or methacrylic acid; ethylene-acrylate terpolymers: ethylene-acrylic esters-maleic anhydride or glycidyl methacrylate terpolymers; ethylene-acrylic acid ionomers; and combinations thereof.

3. The ink of claim 1, wherein the carrier liquid has a dielectric constant of less than 2.

4. The ink of claim 1, wherein the ink has from about 1% to about 45% non-volatile solids.

5. A method of forming a liquid electrophotographic ink composition comprising:

admixing a resin, a carrier liquid, and a pearlescent pigment at a temperature above a cloud point for the resin up to about 140° C. to form a paste;

diluting the paste to form a slurry; and forming a liquid electrophotographic ink with the slurry and a charge director;

wherein the resin, the carrier liquid, and the pearlescent pigment are not subjected to mechanical deformation, wherein a temperature during the method of forming a liquid electrophotographic ink decreases from the temperature above the cloud point for the resin to about 20° C., and wherein the pearlescent pigment includes alternating layers of a material with a low refractive index and a material with a high refractive index that are interchanged repeatedly.

6. The method of claim 5, wherein the temperature of the method progressively decreases from about 140° C. to about 20° C. prior to the diluting of the paste.

7. The method of claim 5, wherein the admixing occurs under high shear conditions.

8. The method of claim 7, wherein the high shear conditions include a temperature of about 30° C. at about 15,000 rpm for about 1 hour.

9. The method of claim 7, wherein the pearlescent pigment is a metamer.

10. The ink of claim 1, wherein resin encapsulated pigment has a melting point from about 30° C. to about 150° C.

11. The method of claim 5, wherein resin encapsulated pigment has a melting point from about 30° C. to about 150° C.

* * * * *